US011608675B2

(12) United States Patent
Wang

(10) Patent No.: US 11,608,675 B2
(45) Date of Patent: Mar. 21, 2023

(54) SAFETY GATE

(71) Applicant: DEMBY DEVELOPMENT CO., LTD., New Taipei (TW)

(72) Inventor: Tsung-Hsiang Wang, New Taipei (TW)

(73) Assignee: DEMBY DEVELOPMENT CO., LTD., New Taipei (TW)

( * ) Notice: Subject to any disclaimer, the term of this patent is extended or adjusted under 35 U.S.C. 154(b) by 134 days.

(21) Appl. No.: 17/017,917

(22) Filed: Sep. 11, 2020

(65) Prior Publication Data

US 2021/0079700 A1 Mar. 18, 2021

(30) Foreign Application Priority Data

Sep. 18, 2019 (CN) ..... CN201921552371

(51) Int. Cl.

| | |
|---|---|
| ***E06B 9/04*** | (2006.01) |
| ***E05C 3/00*** | (2006.01) |
| ***E05C 3/14*** | (2006.01) |
| ***E05D 3/02*** | (2006.01) |

(Continued)

(52) U.S. Cl.

CPC ..... *E06B 9/04* (2013.01); *E05C 3/004* (2013.01); *E05C 3/145* (2013.01); *E05D 3/02* (2013.01); *E05D 7/1044* (2013.01); *E06B 2009/002* (2013.01)

(58) Field of Classification Search

CPC .. E06B 2009/002; E06B 9/04; E05B 65/0014; E05D 15/50; E05D 15/502; E05D 15/505

See application file for complete search history.

(56) References Cited

U.S. PATENT DOCUMENTS 687,733 A * 12/1901 Eldred
1,059,415 A * 4/1913 Waters et al. ..... E05F 1/1215 292/335
2,603,895 A * 7/1952 Hardy ..... 16/230

(Continued)

OTHER PUBLICATIONS

Easy Swing & Lock Baby Gate, Toddleroo by North States (47.85" Wide : Ideal for Wider Areas and stairways. Hardware Mount. Fits Openings 28.68"-47.85" Wide (31" Tall, Matte Bronze)), Customer question & answer—an answer by Renee Garrison on Oct. 15, 2013 (p. 7), https://www.amazon.com/Puerta-supergate-met%C3%A1lica-States-Industries/dp/8005JN6 304.

*Primary Examiner* — Gregory J Strimbu
(74) *Attorney, Agent, or Firm* — Alan D. Kamrath; Karin L. Williams; Mayer & Williams PC

(57) ABSTRACT

A safety gate has a gate body and two first locking units. The gate body has two first connecting elements. The two first locking units are respectively mounted on two opposite sides of a door frame. Each first locking unit has a second connecting element and a blocking element. When the safety gate is closed, each of the first connecting elements is connected with a respective one of the second connecting elements. Each blocking element has a blocking position for blocking a corresponding first connecting element to prevent the corresponding first connecting element from being disengaged from the second connecting element and a pressed position to allow-the corresponding first connecting element to detach from the second connecting element of the first locking unit.

13 Claims, 11 Drawing Sheets

(51) Int. Cl.
*E05D 7/10* (2006.01)
*E06B 9/00* (2006.01)

(56) References Cited

U.S. PATENT DOCUMENTS

| | | | | | |
|---|---|---|---|---|---|
| 3,030,717 | A * | 4/1962 | Lewis | E05D 15/502 | 49/245 |
| 4,083,591 | A * | 4/1978 | Parisien | E05B 65/06 | 292/202 |
| 4,475,309 | A * | 10/1984 | Porter | E06B 9/02 | 49/55 |
| 10,697,236 | B2 * | 6/2020 | King | E05D 7/02 | |
| 11,015,386 | B2 * | 5/2021 | Wang | E05B 63/0008 | |
| 11,149,488 | B2 * | 10/2021 | Wang | E06B 9/04 | |
| 2013/0227892 | A1 * | 9/2013 | Robinson | E04H 17/22 | 49/397 |
| 2014/0007506 | A1 * | 1/2014 | Huang | E05B 65/0007 | 49/394 |
| 2015/0101253 | A1 * | 4/2015 | Marsden | E05C 19/003 | 49/386 |
| 2019/0085620 | A1 | 3/2019 | Wang | | |
| 2020/0340295 | A1 | 10/2020 | Wang | | |

* cited by examiner

SAFETY GATE

BACKGROUND OF THE INVENTION

1. Field of the Invention

The present invention relates to a safety gate.

2. Description of the Prior Arts

A conventional safety gate is placed across passageways to block access to a specific area such as kitchen, balcony, stairway, or any areas with potential danger. The conventional safety gate can only be opened by an adult, and children cannot open the conventional safety gate by themselves to prevent children from assessing the dangerous areas. However, the conventional safety gate has a side pivotally connected to a door frame and the other side thereof is applied for a user to open. Because only one side of the conventional safety gate can be opened, it is less convenient to a user with a dominant hand opposite to an openable side of the conventional safety gate or a user whose hand near the openable side of the conventional safety gate is inconvenient to open the conventional safety gate.

To overcome the shortcomings, the present invention provides a safety gate to mitigate or obviate the aforementioned problems.

SUMMARY OF THE INVENTION

The main objective of the present invention is to provide a safety gate, and the convenience of opening and closing the safety gate can be enhanced.

The safety gate comprises a gate body having two first connecting elements and two first locking units respectively mounted on two opposite sides of a door frame. Each of the first locking units has a second connecting element and a blocking element. When the safety gate is closed, each of the first connecting elements is connected with the second connecting element of the respective one of the first locking units. The blocking element of each of the first locking units has a blocking position for blocking a corresponding one of the first connecting elements to prevent it from being disengaged from the second connecting element of the first locking unit and a pressed position for detaching the corresponding one of the first connecting elements from the second connecting element of the first locking unit.

Other objectives, advantages and novel features of the invention will become more apparent from the following detailed description when taken in conjunction with the accompanying drawings.

DETAILED DESCRIPTION OF THE PREFERRED EMBODIMENTS

It should be noted that when a component is referred to as being "fixed" to another component, it can be directly mounted on said another component or still another component may be disposed between the component and said another component. When a component is considered to be "connected" to another component, it can be directly connected to said another component or still another component may be disposed between the component and said another component. The terms "vertical," "horizontal," "left," "right," and the like, as used herein, are for the purpose of illustration and are not intended to be the only embodiment.

Figure 1:
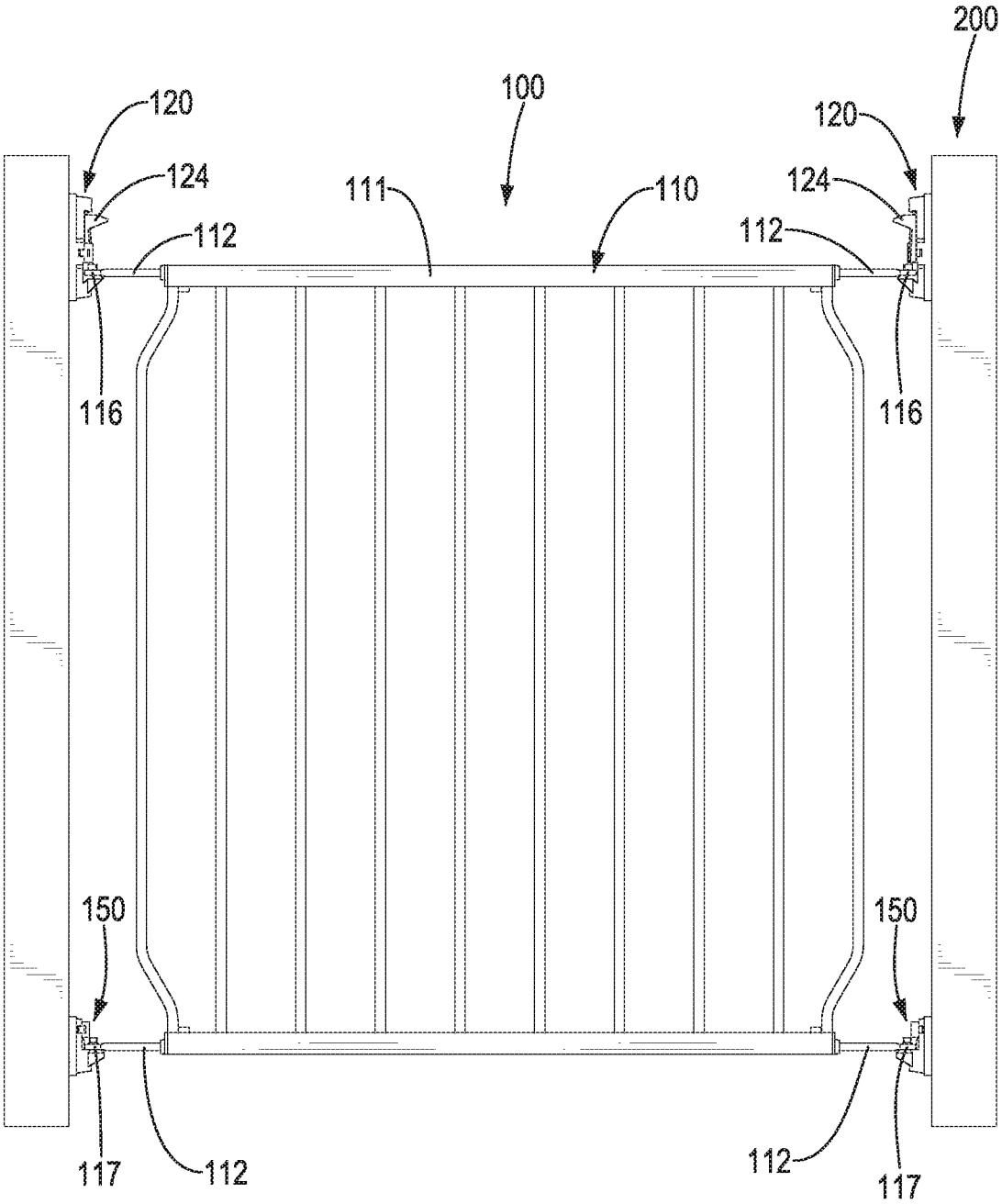
FIG. 1 is a front side view of a safety gate in accordance with the present invention.
Figure 2:
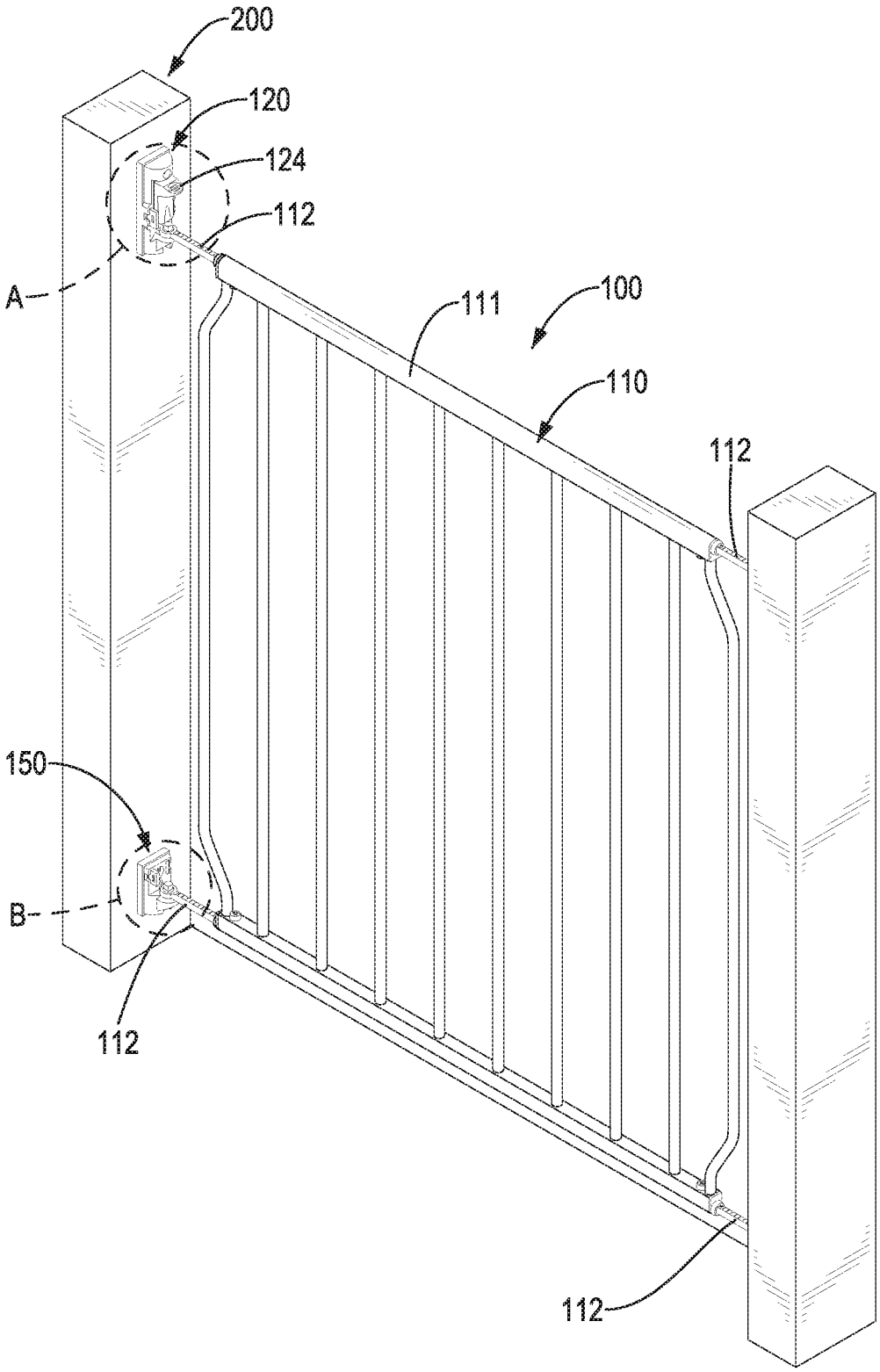
FIG. 2 is perspective view of the safety gate in FIG. 1.
Figure 3:
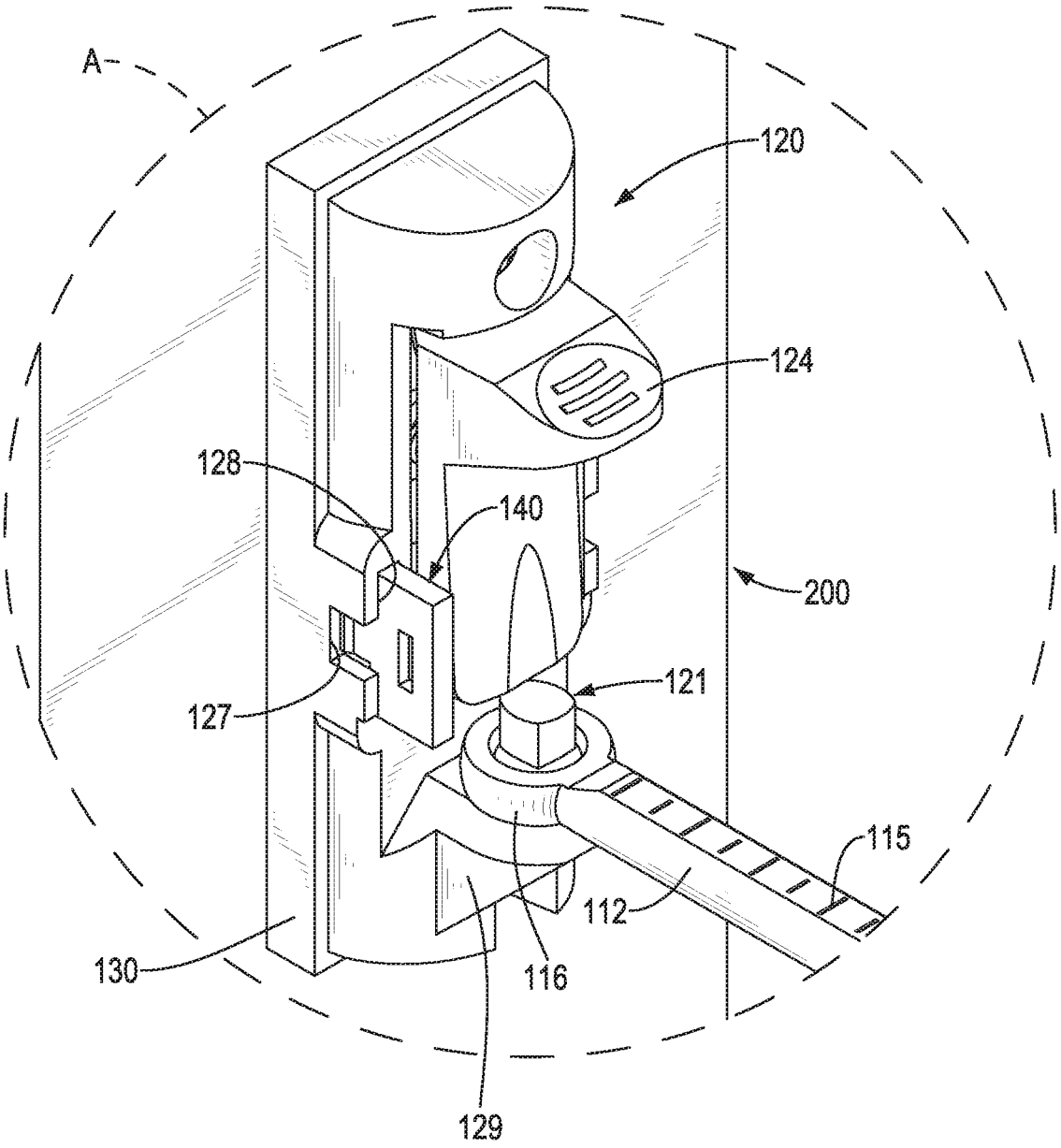
FIG. 3 is an enlarged perspective view of the safety gate of a portion A in FIG. 2.

With reference to FIGS. 1, 2, and 3, a safety gate 100 in accordance with the present invention is applied to detachably mount in a door frame 200 to block a passageway formed in the door frame 200. The safety gate 100 may be opened for a user passing the passageway formed in the door frame 200. The safety gate 100 has a gate body 110 and two first locking units 120 respectively mounted on two opposite sides of the door frame 200. The gate body 110 has two first connecting elements 116 respectively disposed on two opposite sides thereof. Each of the first connecting elements 116 is connected with a respective one of the first locking units 120 to install the gate body 110 in the door frame 200.

Each first locking unit 120 has a second connecting element 121 and a blocking element 124. Each of the first connecting elements 116 is rotatably connected with the second connecting element 121 of a respective one of the first locking units 120. The blocking element 124 has a blocking position and a pressed position. When in the blocking position, the blocking element 124 blocks the first connecting element 116 to prevent it from being disengaged from the second connecting element 121. Thus, the gate body 110 is securely mounted in the door frame 200. When in the pressed position, the first connecting element 116 can be detached from the second connecting element 121 to detach the gate body 110 from the door frame 200.

Figure 6:
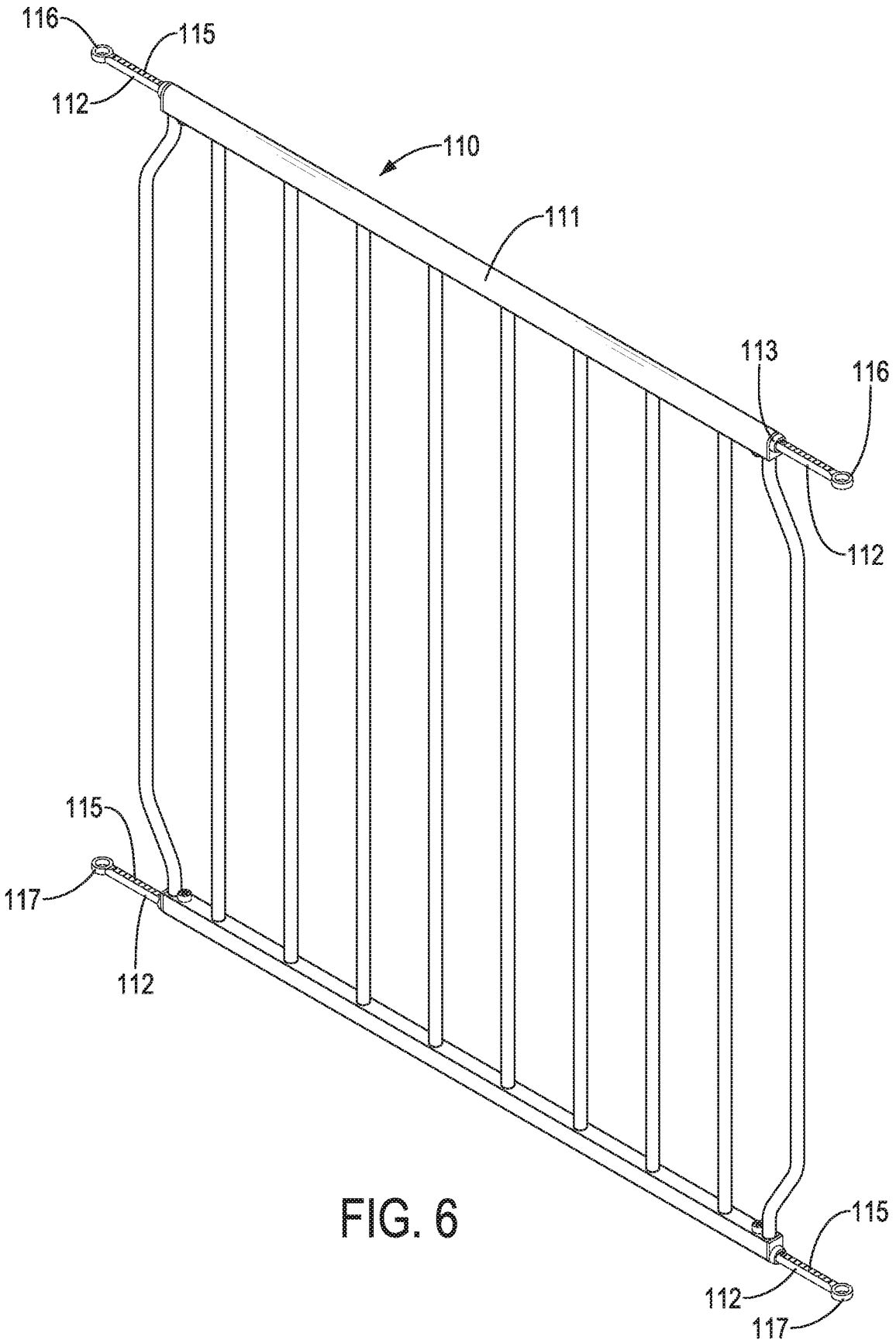
FIG. 6 is a perspective view of a gate body of the safety gate in FIG. 2.

Specifically, with reference to FIGS. 1 and 6, the gate body 110 is substantially rectangular, and the shape of the gate body 110 is symmetrical along a vertical central line thereof. The gate body 110 is vertically mounted in the door frame 200. The two first connecting elements 116 are respectively disposed on two corners of the gate body 110 away from the ground. The two first locking units 120 are mounted on the two opposite sides of the door frame 200 and are aligned with the two first connecting elements 116, respectively. Each first connecting element 116 is rotatably connected with the second connecting element 121 of the respective one of the first locking units 120 to secure the gate body 110 in the door frame 200. To open the safety gate 100, one of the blocking elements 124 is in the pressed position, the corresponding first connecting element 116 is detached from the corresponding second connecting element 121, and the gate body 110 is pivoted around the second connecting element 121 of the other first locking unit 120 to open the safety gate 100.

Since each of the two first connecting elements 116 is detachable from the respective one of the second connecting elements 121, the gate body 110 can be pivoted around any of the second connecting elements 121. The gate body 110 can be opened from each of the two opposite sides of the door frame 200. Since the shape of the gate body 110 is symmetrical along the vertical central line thereof, one of the first connecting elements 116 can be connected with any one of the second connecting elements 121, and the other one of the first connecting elements 116 is connected with the other one of the second connecting elements 121. Each first connecting element 116 may not need to be connected to a specified second connecting element 121, thereby assembly convenience can be enhanced. Because the first connecting element 116 is rotatably connected with the second connecting element 121, the first connecting element 116 can be connected to the second connecting element 121 via angular directions.

Accordingly, the two first locking units 120 can be respectively mounted on surfaces of the two opposite sides of the door frame 200 facing each other, or other side surfaces of the two opposite sides of the door frame 200. The surfaces of the door frame 200 for mounting the first locking units 120 may be planes or curved surfaces. The first locking units 120 can be mounted on the two opposite sides of the door frame 200 in different angular directions. After mounting the first locking units 120 on the door frame 200, the first connecting elements 116 can be connected to the first locking units 120 via corresponding angular directions to mount the gate body 110 in the door frame 200.

The first connecting elements 116 can be arranged in any positions on the two opposite sides of the gate body 110, and the first locking units 120 are mounted on corresponding positions on the two opposite sides of the door frame 200 to secure the gate body 110 in the door frame 200 and to open the safety gate 100 from the two opposite sides of the door frame 200. The gate body 110 may not be perpendicular to the ground. Angles of the first locking units 120 relative to the ground can be adjusted to align with the gate body 110 for the first connecting elements 116 to connect to the second connecting elements 121.

With reference to FIG. 3, the blocking element 124 is movable toward or away from the door frame 200. The second connecting element 121 longitudinally extends and is parallel to two opposite sides of the door frame 200. The first connecting element 116 is movably along the longitudinal direction of the second connecting element 121 to detach from the second connecting element 121. When the blocking element 124 is set in the blocking position, the blocking element 124 is located away from the door frame 200 to block in a path for detaching the first connecting element 116 from the second connecting element 121. When the blocking element 124 is set in the pressed position, the blocking element 124 is in a position near the door frame 200, and the first connecting element 116 can be detached from the second connecting element 121.

Specifically, the first connecting element 116 is moved away from the ground to detach from the second connecting element 121. When one of the first connecting elements 116 is detached from the corresponding one of the second connecting elements 121, the side of the gate body 110 that is near the corresponding one of the second connecting elements 121 is moved away from the ground.

Figure 4:
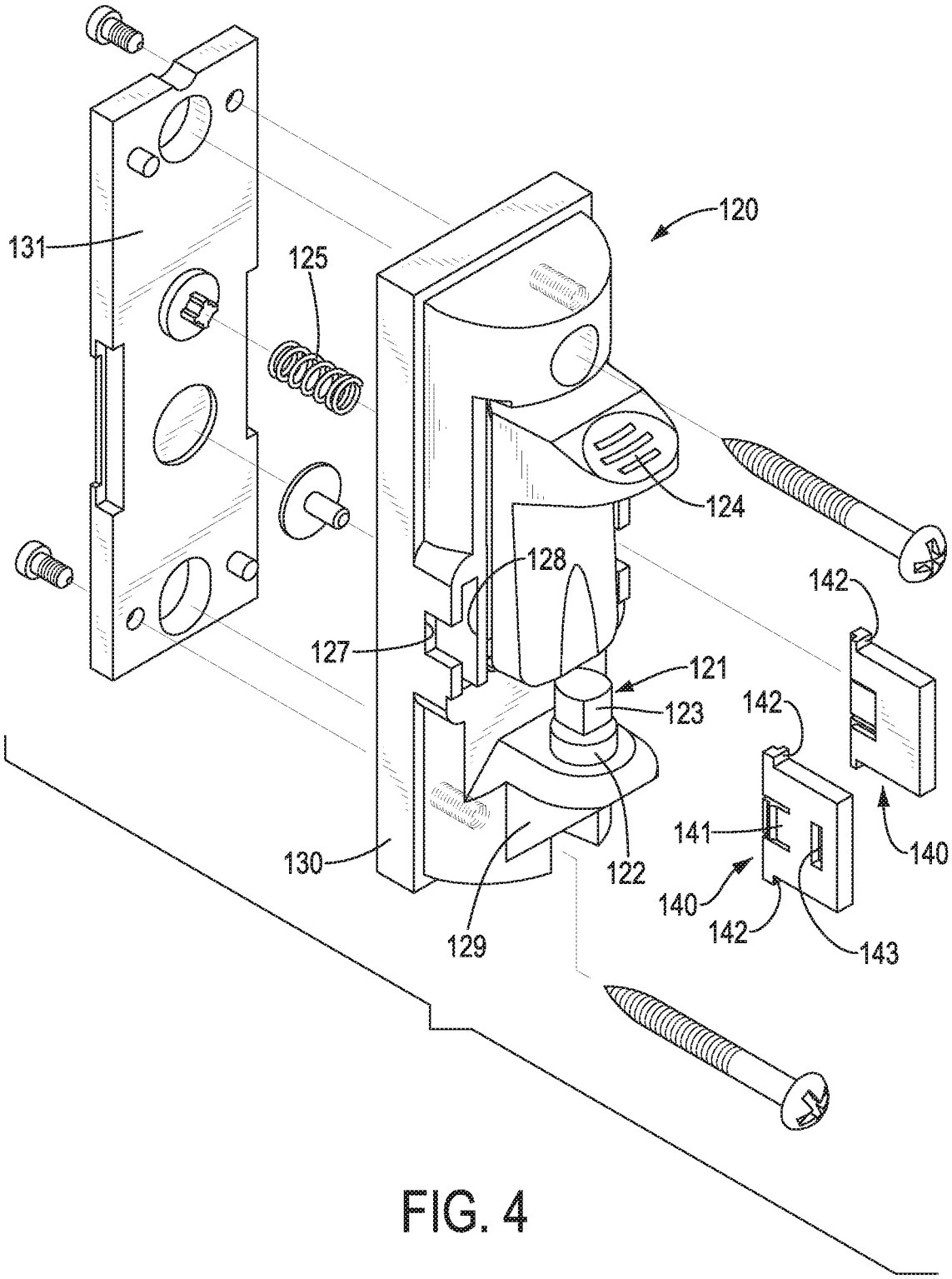
FIG. 4 is an exploded perspective view of a first locking unit of the safety gate in FIG. 3.

Specifically, with reference to FIG. 4, the blocking element 124 has a spring 125 mounted therein. When pressed to compress the spring 125, the blocking element 124 is set in the pressed position. When the blocking element 124 is released, the spring 125 is resilient to move the blocking element 124 away from the door frame 200 to the blocking position.

Figure 5:
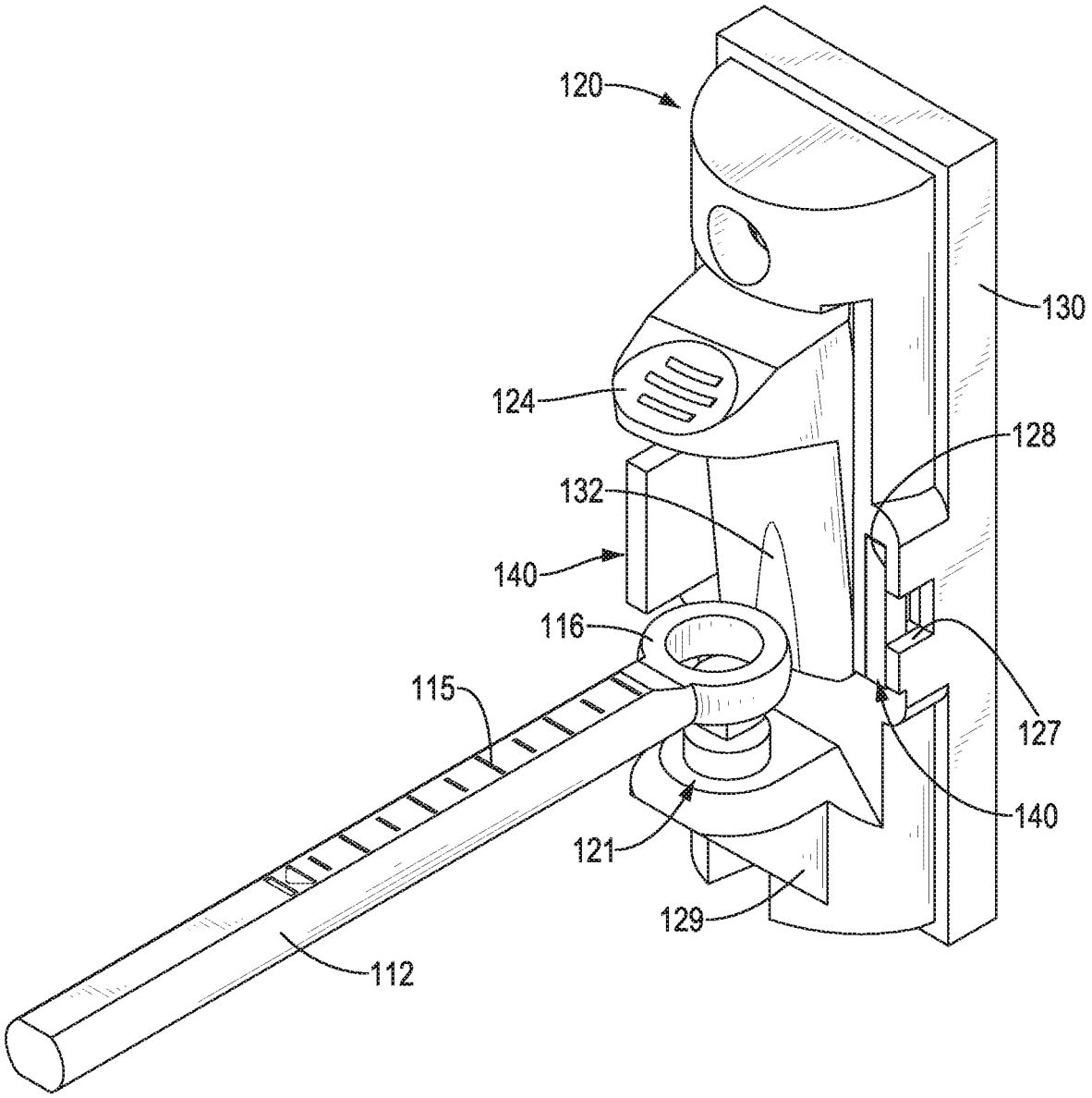
FIG. 5 is an operational perspective view of the safety gate in FIG. 1 showing that a first connecting element is pressing a blocking element.

With reference to FIG. 5, the blocking element 124 has a positioning recess 132 recessed in a surface thereof away from the door frame 200 and located above the second connecting element 121. When the blocking element 124 is set in the pressed position, the first connecting element 116 can be detached from and is engaged with the second connecting element 121 through the positioning recess 132. When closing the safety gate 100, the first connecting element 116 is slid along the positioning recess 132 to connect and engage with the second connecting element 121. Thus, the safety gate 100 can be closed conveniently, and shaking of the gate body 110 can be reduced to improve efficient alignment of the first connecting element 116 with the second connecting element 121.

With reference to FIG. 3, the first connecting element 116 is substantially annular, the second connecting element 121 is substantially rod-shaped, and the first connecting element 116 surrounds the second connecting element 121. Selectively, the first connecting element 116 may be a cylinder, the second connecting element 121 may be a hollow sleeve, and the first connecting element 116 is inserted in the second connecting element 121. Moreover, the first connecting element 116 can be rotatably connected to and detached from the second connecting element 121 by any other means of connection.

With reference to FIG. 4, the second connecting element 121 has a positioning portion 122 and a slidable portion 123 adjacent to the blocking element 124. The first connecting element 116 is rotatably connected with the positioning portion 122. The first connecting element 116 is detached from the second connecting element 121 through the slidable portion 123. The positioning portion 122 has an outer diameter matching an inner diameter of the first connecting element 116, and an outer diameter of the slidable portion 123 is smaller than the outer diameter of the positioning portion 122.

Because the outer diameter of the positioning portion 122 matches the inner diameter of the first connecting element 116, when the first connecting element 116 is rotated relative to the positioning portion 122, the gate body 110 can be limited by the positioning portion 122 to reduce shaking. In addition, the second connecting element 121 can withstand large impact without damage. When one of the first connecting elements 116 is detached from the positioning portion 122 of the corresponding one of the second connecting elements 121, the first connecting element 116 is oblique relative to the corresponding second connecting element 121 and is slid to the slidable portion 123. Because the outer diameter of the slidable portion 123 is smaller than the outer diameter of the positioning portion 122, a gap formed between of the first connecting element 116 and the slidable portion 123 is large enough for the first connecting element 116 to be easily moved through the slidable portion 123 to open the safety gate 100.

Figure 7:
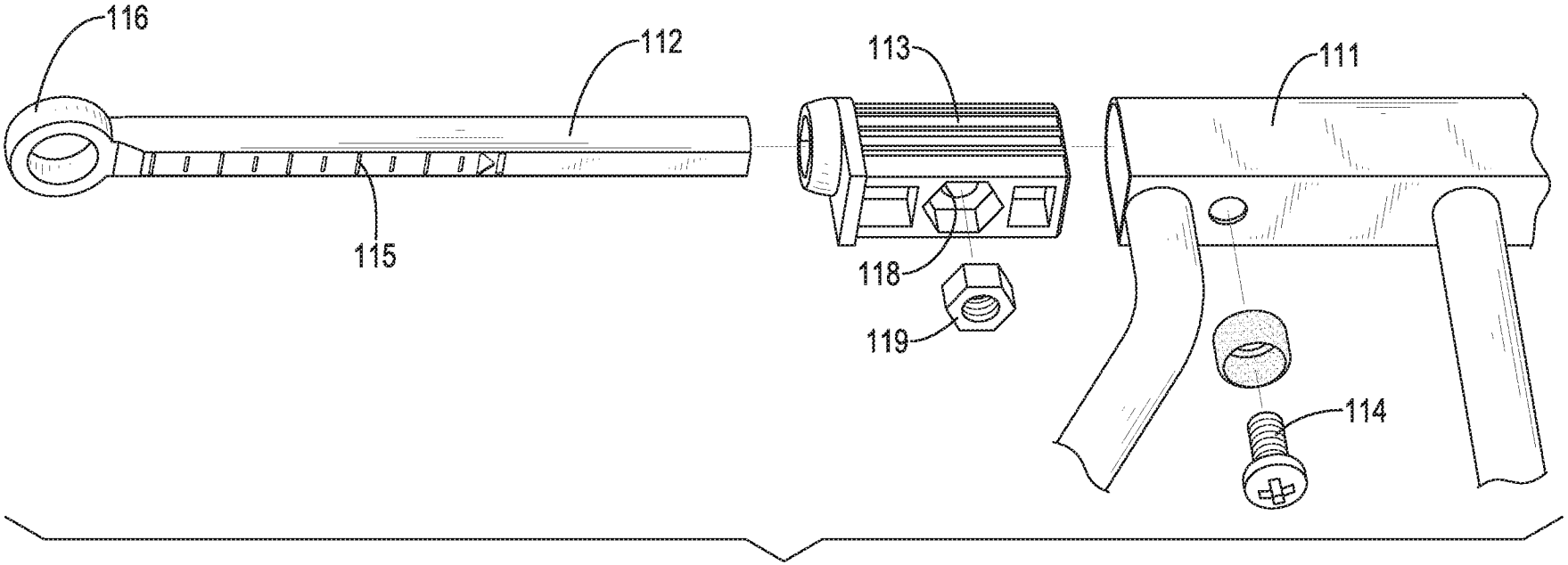
FIG. 7 is an enlarged exploded perspective view of the gate body of the safety gate in FIG. 6.
Figure 8:
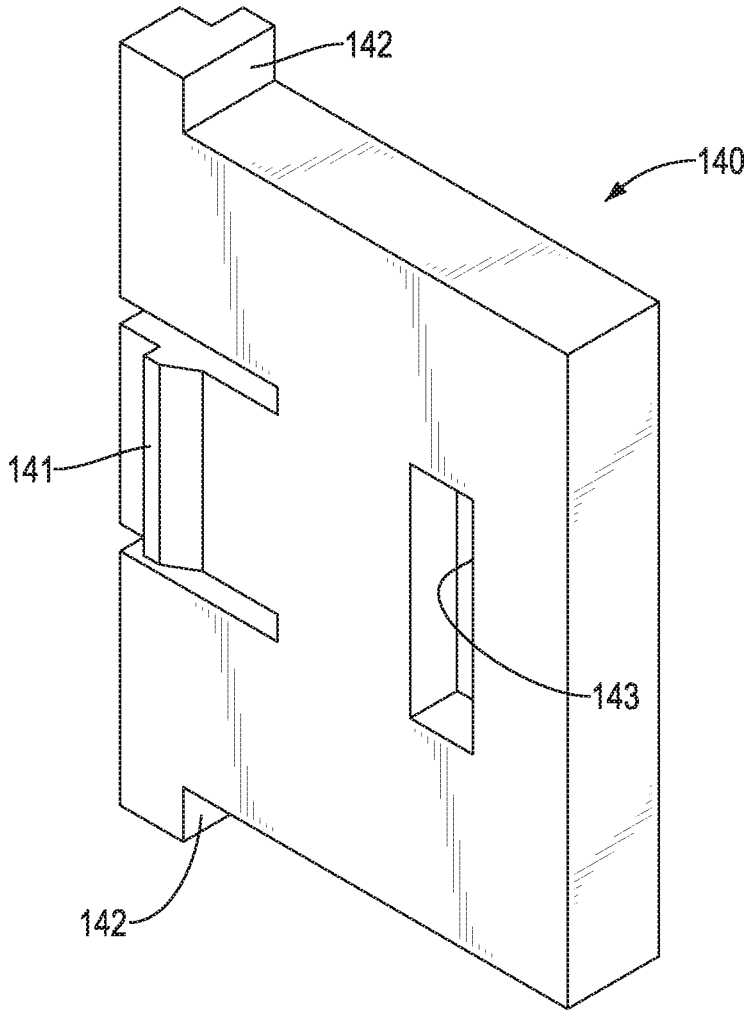
FIG. 8 is an enlarged perspective view of a stopping block of the safety gate in FIG. 4.

With reference to FIGS. 6 and 7, the gate body 110 has a main body 111 and two connecting rods 112 adjustably connected with two opposite sides of the main body 111, respectively. Each connecting rod 112 is partially overlapping and mounted in the main body 111. An overlapping length of each connecting rod 112 relative to the main body 111 is adjustable. Each of the two first connecting elements 116 is located on an end of a respective one of the two connecting rods 112 away from the main body 111.

Since the overlapping lengths of the connecting rods 112 relative to the main body 111 are adjustable, a width of the whole gate body 110 is adjustable. The width of the gate body 110 can be adjusted accordingly to fit a width between the two opposite sides of the door frame 200. Thus, the gate body 110 can be applied to door frames 200 of various widths. In addition, the position of the first connecting element 116 can be adjusted to connect with the second connecting element 121 from different angles. Thus, the first locking unit 120 can be mounted on the door frame 200 at different angles.

Specifically, with reference to FIG. 7, the gate body 110 has a fastening mount 113 and a fastener 114. The fastening mount 113 is fixed in an end of the main body 111. The connecting rod 112 is slidably and partially mounted in the fastening mount 113. The fastener 114 is inserted into the main body 111 and the fastening mount 113 and abuts against the connecting rod 112. The connecting rod 112 is slid relative to the fastening mount 113 to adjust the overlapping length of the connecting rod 112 relative to the main body 111 according to the width of the door frame 200. Then, the fastener 114 is inserted into the main body 111 and the fastening mount 113 to abut against the connecting rod 112. Thus, the connecting rod 112, the fastening mount 113, and the main body 111 are securely connected with each other.

Specifically, with reference to FIG. 7, each fastening mount 113 has a nut cavity 118 recessed therein. The gate body 110 has two nuts 119, and each nut 119 is mounted in and engaged with the nut cavity 118 of the respective one of the fastening mounts 113. The fastener 114 is inserted into the main body 111 and connected with the nut 119 by threaded connection. With the arrangement of the nut 119, the fastener 114 is directly connected with the nut 119. Thus, the fastening mount 113 may not have a thread formed therein to connect with the fastener 114. In addition, the fastener 114 may be a flat-headed bolt. A cushion is mounted between the fastener 114 and the main body 111. The head of the fastener 114 is mounted in the cushion to prevent the fastener 114 from scratching hands and to provide a good visual appeal.

Selectively, the fastening mounts 113 may be omitted. The connecting rod 112 is slidably and partially mounted in the main body 111. The fastener 114 is inserted into the main body 111 to abut against the connecting rod 112. With the arrangement of the fastening mount 113, attritions between the connecting rod 112 and the main body 111 can be reduced to prevent the main body 111 from wearing, and the connecting rod 112 can be securely connected with the main body 111. The connecting rod 112 is partially mounted in the main body 111, assembly spaces can be reduced, and the connecting rod 112 can be protected. The connecting rod 112 may not be mounted in the main body 111 but slidably abuts against the main body 111. The fastener 114 is mounted through the connecting rod 112 and the main body 111 and securely connects therebetween.

With reference to FIGS. 3, 4, 8, and 11, the first locking unit 120 has two stopping blocks 140 respectively disposed at two opposite sides of the second connecting element 121. When the first connecting element 116 is detached from the second connecting element 121, the first connecting element 116 may be moved away from the second connecting element 121 via a direction facing one of the stopping blocks 140. Each stopping block 140 has a retracting position and a stopping position. When the stopping block 140 is disposed in the stopping position, the stopping block 140 blocks a swing path for moving the first connecting element 116 away from the second connecting element 121. When the stopping block 140 is disposed in the retracting position, the first connecting element 116 can be moved away from the second connecting element 121 via the direction facing the stopping block 140.

The stopping block 140 has a snap 141 and two flanges 142 respectively located at two opposite sides of the snap 141. The first locking unit 120 has two mounting cavities 128, and each mounting cavity 128 is disposed on a respective stopping block 140. Each mounting cavity 128 has an engaging recess 127 recessed therein and two abutting portions 126 formed in two opposite sides of the mounting cavity 128 and selectively abutting against the two flanges 142 of the stopping block 140. When in the retracting position, the stopping block 140 is inside the mounting cavity 128 for moving the first connecting element 116 away from the first locking unit 120 via the side that faces the stopping block 140. When in the stopping position, the stopping block 140 partially protrudes from the mounting cavity 128 and the flanges 142 abut against the abutting portions 126, and the snap 141 is engaged with the engaging recess 127. With reference to FIG. 5, the stopping block 140 on the left side of the second connecting element 121 is in the stopping position, and the stopping block 140 at the right side of the second connecting element 121 is in the retracting position.

The snap 141 is flexible. When the stopping block 140 protrudes from the mounting cavity 128 and the flanges 142 abut against the abutting portions 126, the snap 141 protrudes from the mounting cavity 128, is mounted in and engaged with the engaging recess 127 to stop the stopping block 140 from further moving into the mounting cavity 128. The engagements between the flanges 142 and the abutting portions 126 can prevent the stopping block 140 from detaching from the mounting cavity 128. After the snap 141 is pressed to disengage from the engaging recess 127, the stopping block 140 can move into the mounting cavity 128. Preferably, the stopping block 140 has a slot 143 for a tool, such as a flat-head screwdriver, inserted therein to move the stopping block 140 toward or away from the mounting cavity 128. Thus, the stopping block 140 can be moved conveniently.

The two stopping blocks 140 are respectively located at two opposite sides of the second connecting element 121. When the two stopping blocks 140 are disposed in the retracting positions, the first connecting element 116 can be moved away from the second connecting element 121 via any one of the two opposite sides thereof. Thus, the safety gate 100 can be opened via two sides of the first locking unit 120. When one of the stopping blocks 140 is disposed in the stopping position, the first connecting element 116 can only be moved away from the second connecting element 121 via the other side thereof. Thus, the safety gate 100 can be opened via one side of the first locking unit 120. With the arrangement of the stopping blocks 140, the safety gate 100 can be switched to be opened from one side or two sides. For example, when the safety gate 100 is mounted in an entrance to a dangerous area, such as the stairway and the balcony, the safety gate 100 can be switched to be opened from one side to prevent the safety gate 100 from pivoting into the stairway or the balcony.

With reference to FIG. 4, the first locking unit 120 has a first fixing portion 129, a housing 130, and a cover 131. The second connecting element 121 is fixed on the first fixing portion 129. The first fixing portion 129 and the blocking element 124 are connected with the housing 130. The housing 130 is securely connected with the cover 131. The cover 131 is securely connected with the door frame 200. Selectively, the housing 130 may be connected with the first fixing portion 129 and the blocking element 124 by integrally forming, welding, or threaded connection, but it is not limited thereto. Blots are mounted through the housing 130, the cover 131, and the door frame 200 to securely connect the housing 130, the cover 131, and the door frame 200 with each other. The housing 130 and the cover 131 may be formed integrally, by welding, to be engaged with each other, or securely connected with each other by any other suitable means of connection.

Figure 9:
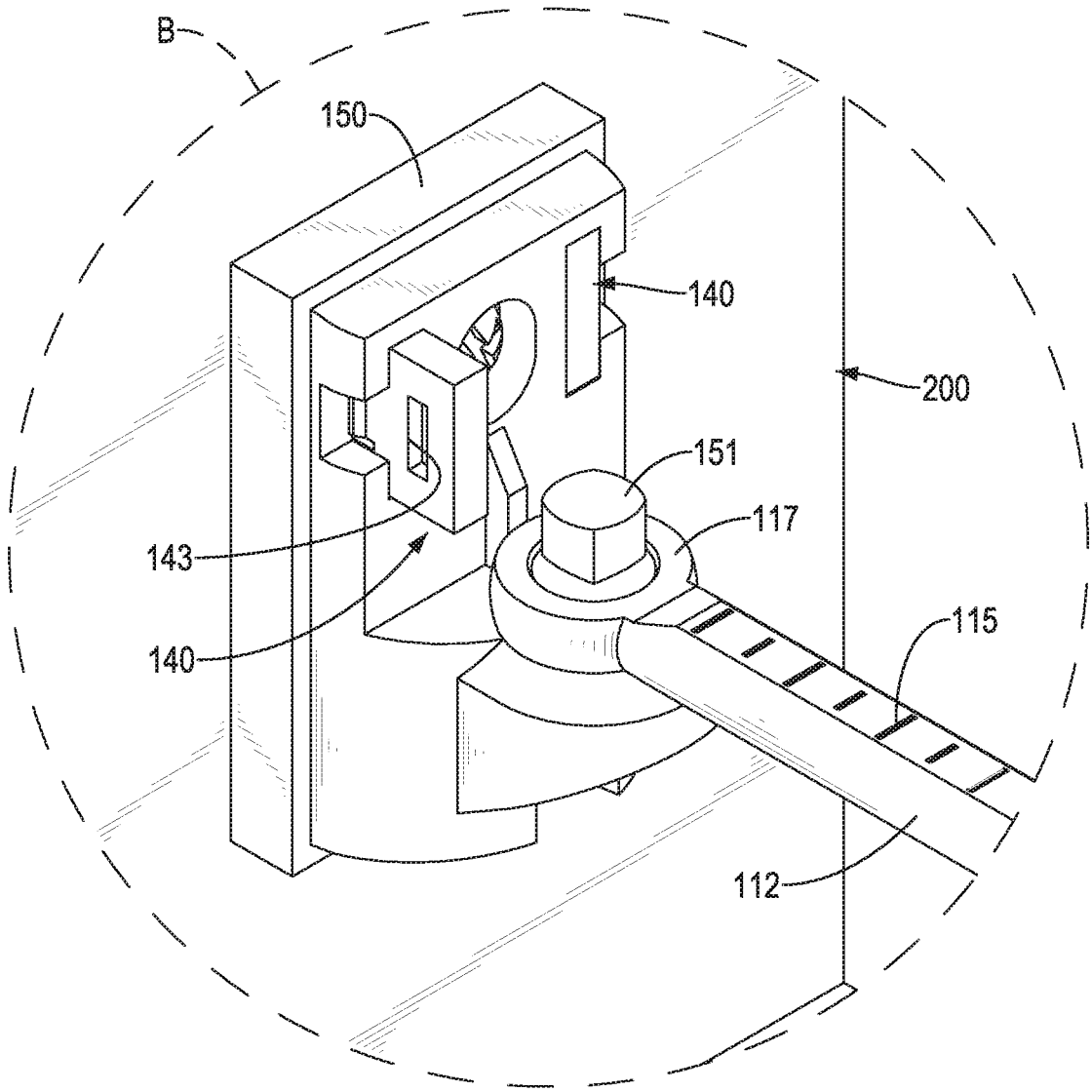
FIG. 9 is an enlarged perspective view of the safety gate of a portion B in FIG. 2.
Figure 10:
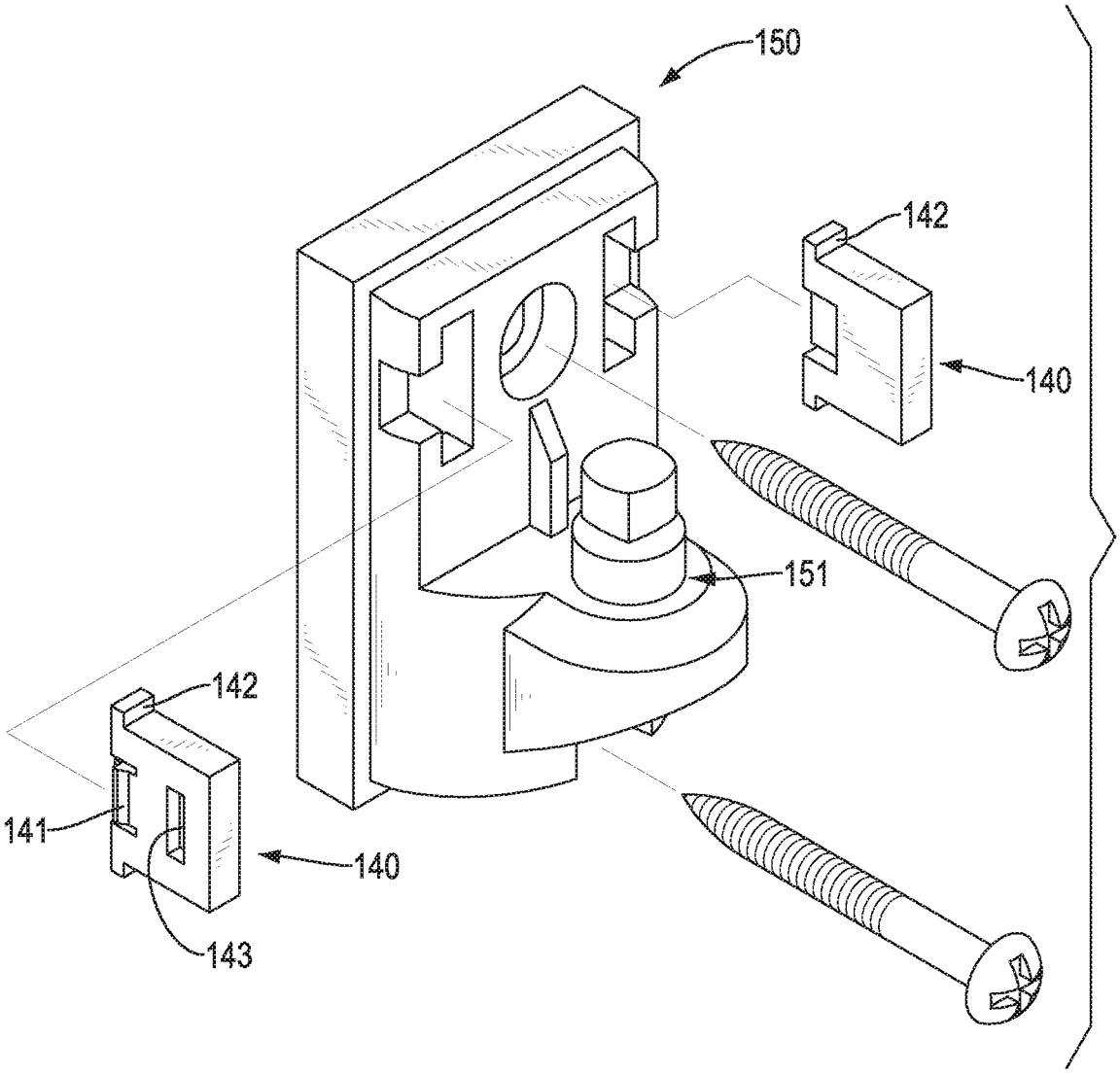
FIG. 10 is an exploded perspective view of a second locking unit of the safety gate in FIG. 9.
Figure 11:
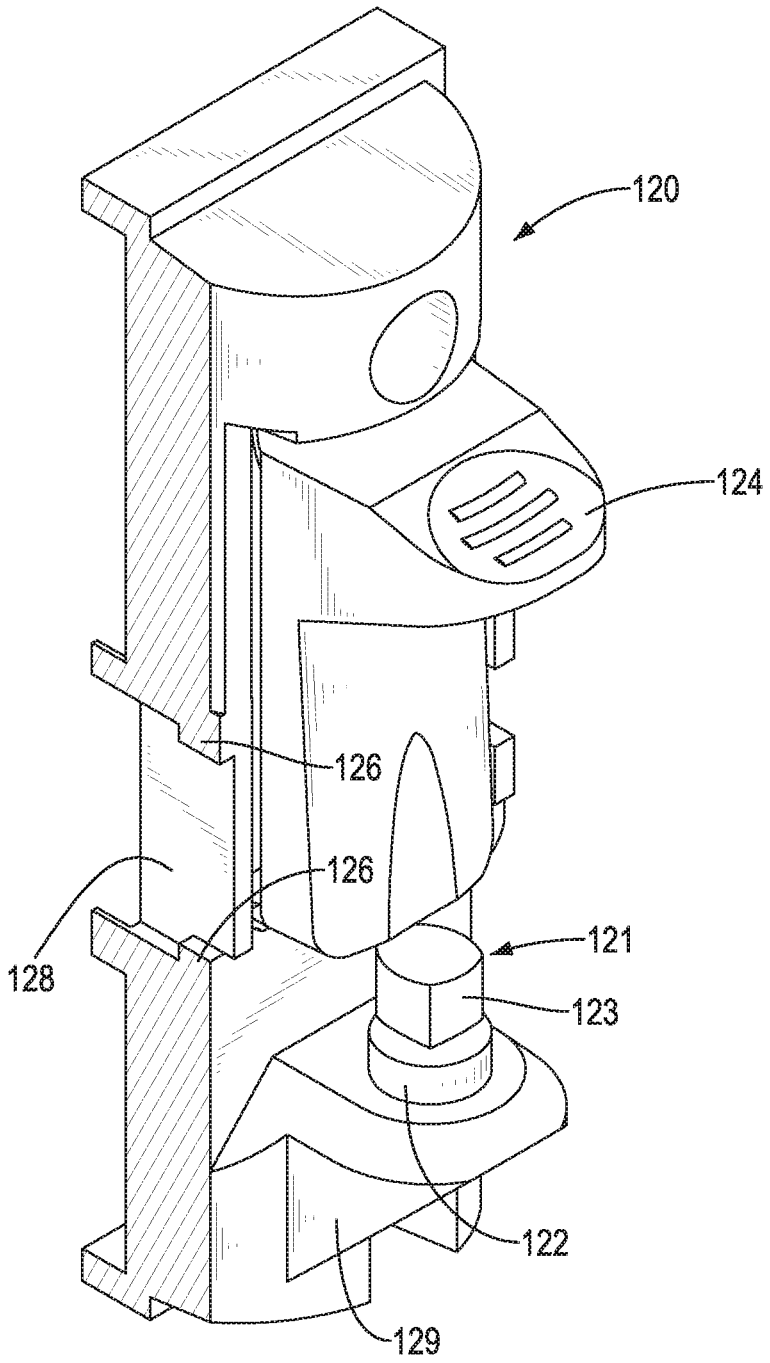
FIG. 11 is a cross sectional perspective view of the first locking unit of the safety gate in FIG. 4.

With reference to FIGS. 2, 9, and 10, the safety gate 100 further comprises two second locking units 150 respectively mounted on the two opposite sides of the door frame 200. The gate body 110 has two third connecting elements 117. Each of the two second locking units 150 has a fourth connecting element 151. Each of the two third connecting elements 117 is rotatably connected with a respective one of the fourth connecting elements 151.

With reference to FIG. 6, the gate body 110 has four connecting rods 112. Two of the connecting rods 112 are respectively disposed on two of the corners of the gate body 110 near the ground. Each third connecting element 117 is located on the end of a respective one of the connecting rods 112 away from the main body 111. The connection between the third connecting element 117 and the fourth connecting element 151 may be same as the connection between the first connecting element 116 and the second connecting element 121, so details thereof are omitted. With the arrangement of the two second locking units 150, the connection between the gate body 110 and the door frame 200 is more stable to reduce the shaking of the gate body 110. In addition, the second locking unit 150 may have two stopping blocks 140 located at two opposite sides of the fourth connecting element 151. The stopping blocks 140 of the second locking unit 150 are arranged in the same positions as the stopping blocks 140 of the first locking unit 120. Accordingly, the safety gate 100 can be switched to be opened via one side or two sides.

In addition, with reference to FIG. 7, each of the connecting rods 112 has indicating marks 115 for ease of quantitatively adjusting the overlapping length of the connecting rod 112 and the main body 111. Lengths of the connecting rod 112 protruding from the same side of the main body 111 can be easily adjusted into the same. The gate body 110 can be applied to the door frames 200 having different widths easily, and the gate body 110 can be installed on the door frame 200 horizontally.

The gate body 110 may be symmetrical along a horizontal central line thereof. Thus, the gate body 110 may be mounted in the door frame 200 without being limited by a specified direction to enhance the assembly convenience.

When installing the safety gate 100, the first locking units 120 and the second locking units 150 are securely connected to the two opposite sides of the door frame 200. The width of the gate body 110 can be adjusted according to the width between the two opposite sides of the door frame 200. The first connecting elements 116 are connected with the second connecting elements 121, and the third connecting elements 117 are connected with the fourth connecting elements 151 to secure the gate body 110 in the door frame 200. To detach the gate body 110 from the door frame 200, the first connecting elements 116 are detached from the second connecting elements 121 and the third connecting elements 117 are detached from the fourth connecting elements 151. The gate body 110 can be mounted in and detached from the door frame 200 conveniently and quickly. After the gate body 110 is mounted in the door frame 200, the positions of the stopping blocks 140 can be adjusted to open the safety gate 100 via one direction or two directions.

To open the safety gate 100, one of the stopping blocks 140 is pressed, and the gate body 110 is moved up to disengage the corresponding one of the first connecting elements 116 from the corresponding one of the second connecting elements 121 and disengage the corresponding one of the third connecting elements 117 from the corresponding one of the fourth connecting elements 151. After that, the gate body 110 can be pivoted around the other one of the second connecting elements 121 and the other one of the fourth connecting elements 151 to open the safety gate 100. To close the safety gate 100, the gate body 110 is pivoted, the first connecting element 116 is connected with the second connecting element 121, the third connecting element 117 is connected with the fourth connecting element 151 again, and the stopping block 140 is returned to the blocking position. In addition, as the gate body 110 is heavy, it can only be lifted up by adults, not by children, thereby preventing the children from opening the safety gate 100.

Accordingly, the safety gate 100 has two first locking units 120 respectively mounted on the two opposite sides of the door frame 200 and the gate body 110 having two first connecting elements 116 connecting with the second connecting elements 121 of the two first locking units 120 to securely connect the gate body 110 in the door frame 200. Each one of the first connecting elements 116 of the gate body 110 can be disengaged from the second connecting element 121 of a corresponding one of the first locking units 120 to open the safety gate 100 from both sides of the door frame 200.

What is claimed is:

1. A safety gate comprising:

a gate body having:

a main body;

two connecting rods respectively adjustably connected with the main body; and two first connecting elements, each of the two first connecting elements formed on an end of a respective one of the two connecting rods; and two first locking units respectively mounted on opposite sides of a door frame, each of the first locking units having:

a second connecting element; and a blocking element located above the second connecting element; wherein when the safety gate is closed, each of the two first connecting elements is connected with the second connecting element of a respective one of the two first locking units from a top of the second connecting element of the respective one of the two first locking units;

when the safety gate is unlatched, one of the two first connecting elements is detached from the second connecting element of the respective one of the two first locking units, and the other one of the two first connecting elements is connected with the second connecting element of the respective one of the two first locking units; and the blocking element of each of the two first locking units is moveable toward and away from the respective one of the opposite sides of the door frame and has:

a blocking position for blocking the corresponding one of the two first connecting elements to prevent the corresponding first connecting element from being disengaged from the second connecting element of the respective one of the two first locking units; and a pressed position to allow the corresponding one of the two first connecting elements to detach from the second connecting element of the respective one of the two first locking units;

wherein when the blocking element of each of the first locking units is located in the blocking position, the blocking element is located a first distance from the respective one of the opposite sides of the door frame to block a path for detaching the corresponding one of the two first connecting elements from the second connecting element of the respective one of the two first locking units, and wherein when the blocking element of each of the first locking units is located in the pressed position, the blocking element is located a second distance, which is less than the first distance, from the respective one of the opposite sides of the door frame, and the corresponding one of the two first connecting elements is able to be moved up to detach from the second connecting element of the respective one of the two first locking units to unlatch the safety gate;

wherein the gate body has fastening mounts and fasteners;

each of the fastening mounts is mounted in a respective end of the main body and has a respective one of the connecting rods slidably and partially mounted therein; and each of the fasteners is inserted into the main body and a respective one of the fastening mounts and abuts against a respective one of the connecting rods.

2. The safety gate as claimed in claim 1, wherein the second connecting element of each of the first locking units extends upwardly; and each of the two first connecting elements is movable along the second connecting element of the respective one of the two first locking units to detach from the second connecting element of the respective one of the two first locking units.

3. The safety gate as claimed in claim 2, wherein the blocking element of each of the first locking units has a positioning recess recessed in a surface of the blocking element; and when the corresponding one of the two first connecting elements is slid along the positioning recess of the blocking element of the respective one of the two first locking units to connect with the second connecting element of the respective one of the two first locking units, the blocking element of the respective one of the first locking units is pressed to move from the blocking position to the pressed position.

4. The safety gate as claimed in claim 1, wherein each of the two first connecting elements is annular;

the second connecting element of each of the two first locking units is rod-shaped; and the first connecting elements respectively surround the second connecting elements of the first locking units when the gate is in the closed position.

5. The safety gate as claimed in claim 4, wherein the second connecting element of each of the first locking units has a positioning portion located a third distance from the blocking element of a respective one of the first locking units and having an outer diameter matching an inner diameter of each of the first connecting elements; and a slidable portion located a fourth distance from the blocking element of the respective one of the first locking units which is less than the third distance and having an outer diameter being smaller than the outer diameter of the positioning portion;

wherein when the safety gate is closed, each of the first connecting elements is connected with the positioning portion of the second connecting element of the respective one of the two first locking units.

6. The safety gate as claimed in claim 5 further comprising two second locking units respectively mounted on the opposite sides of the door frame; wherein the gate body further has two third connecting elements;

each of the two second locking units has a fourth connecting element; and each of the two third connecting elements is rotatably connected with the fourth connecting element of a respective one of the two second locking units when the safety gate is closed.

7. The safety gate as claimed in claim 5, wherein each of the first locking units has two stopping blocks respectively disposed at two opposite sides of the second connecting element of the first locking unit;

each of the stopping blocks of each of the first locking units has a retracting position to allow the corresponding one of the two first connecting elements to move away from the second connecting element of the respective one of the two first locking units; and a stopping position to block a swinging path for moving the corresponding one of the two first connecting elements away from the second connecting element of the respective one of the two first locking units.

8. The safety gate as claimed in claim 7, wherein each of the first locking units has two mounting cavities;

each of the stopping blocks of each of the first locking units is slidably mounted in a respective one of the mounting cavities, wherein when each of the stopping blocks is in the retracting position, the stopping block is inside the respective one of the mounting cavities;

when each of the stopping blocks is in the stopping position, the stopping block partially protrudes from the respective one of the mounting cavities.

9. The safety gate as claimed in claim 5, wherein the blocking element of each of the first locking units has a positioning recess recessed in a surface of the blocking element; and when the corresponding one of the two first connecting elements is slid along the positioning recess of the blocking element of the respective one of the two first locking units to connect with the second connecting element of the respective one of the two first locking units, the blocking element of the respective one of the first locking units is pressed to move from the blocking position to the pressed position.

10. The safety gate as claimed in claim 1, wherein each of the first locking units has two stopping blocks respectively disposed at two opposite sides of the second connecting element of the first locking unit; and each of the stopping blocks of each of the first locking units has a retracting position to allow the corresponding one of the first connecting elements to move away from the second connecting element of the respective one of the two first locking units; and a stopping position to block a swinging path for moving the corresponding one of the two first connecting elements away from the second connecting element of the respective one of the two first locking units.

11. The safety gate as claimed in claim 10, wherein each of the first locking units has two mounting cavities; and each of the stopping blocks of each of the first locking units is slidably mounted in a respective one of the mounting cavities, wherein when each of the stopping blocks is in the retracting position, the stopping block is inside the respective one of the mounting cavities;

when each of the stopping blocks is in the stopping position, the stopping block partially protrudes from the respective one of the mounting cavities.

12. The safety gate as claimed in claim 1, wherein the blocking element of each of the first locking units has a positioning recess recessed in a surface of the blocking element; and when the corresponding one of the two first connecting elements is slid along the positioning recess of the blocking element of the respective one of the two first locking units to connect with the second connecting element of the respective one of the two first locking units, the blocking element of the respective one of the first locking units is pressed to move from the blocking position to the pressed position.

13. The safety gate as claimed in claim 1 further comprising two second locking units respectively mounted on the opposite sides of the door frame; wherein the gate body further has two third connecting elements;

each of the two second locking units has a fourth connecting element; and each of the two third connecting elements is rotatably connected with the fourth connecting element of a respective one of the two second locking units when the safety gate is closed.

* * * * *